US010923027B2

(12) United States Patent
Dong et al.

(10) Patent No.: US 10,923,027 B2
(45) Date of Patent: Feb. 16, 2021

(54) DRIVING CIRCUIT, DISPLAY PANEL, AND CONTROL METHOD THEREOF

(71) Applicant: BOE TECHNOLOGY GROUP CO., LTD., Beijing (CN)

(72) Inventors: Tian Dong, Beijing (CN); Shiming Shi, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/395,136

(22) Filed: Apr. 25, 2019

(65) Prior Publication Data

US 2020/0058250 A1 Feb. 20, 2020

(30) Foreign Application Priority Data

Aug. 17, 2018 (CN) ..... 2018 1 0942594

(51) Int. Cl.
*G09G 3/3225* (2016.01)
*G09G 3/3275* (2016.01)

(52) U.S. Cl.
CPC ..... *G09G 3/3225* (2013.01); *G09G 3/3275* (2013.01); *G09G 2300/0408* (2013.01);
(Continued)

(58) Field of Classification Search
None
See application file for complete search history.

(56) References Cited

U.S. PATENT DOCUMENTS 8,031,161 B2 * 10/2011 Ishii ..... G09G 3/2096 345/100
10,102,799 B2 * 10/2018 Wu ..... G09G 3/3225
(Continued)

FOREIGN PATENT DOCUMENTS

CN 103065556 A 4/2013
CN 105788529 A 7/2016
(Continued)

OTHER PUBLICATIONS

Chinese Office Action dated Nov. 28, 2019, from application No. 201810942594.6.
(Continued)

*Primary Examiner* — David D Davis
(74) *Attorney, Agent, or Firm* — Thomas | Horstemeyer LLP

(57) ABSTRACT

The present disclosure provides a driving method, a display panel and a control method thereof. The driving circuit is configured to drive pixel circuits arranged in an array. The driving circuit includes a plurality of driving modules and a plurality of data writing modules. Each of the plurality of driving modules is connected to two adjacent rows of the pixel circuits through a controlling line and is configured to drive the two adjacent rows of the pixel circuits simultaneously. Each of the plurality of data writing modules is connected to a data line and one column of the pixel circuits, respectively, and is configured to write display data of the data line into a pixel circuit of odd row and a pixel circuit of even row in the one column of pixel circuits in a time sharing manner in response to the driving modules driving the pixel circuits.

13 Claims, 4 Drawing Sheets

(52) U.S. Cl.
CPC ..... *G09G 2300/0426* (2013.01); *G09G 2300/0439* (2013.01); *G09G 2310/08* (2013.01)

(56) References Cited

U.S. PATENT DOCUMENTS

2004/0201581 A1* 10/2004 Miyazawa ..... G09G 3/3233 345/204
2005/0156862 A1* 7/2005 Hirayama ..... G09G 3/3677 345/100
2006/0284683 A1* 12/2006 Ishii ..... G09G 3/3688 330/295
2008/0007499 A1* 1/2008 Kawabe ..... G09G 3/3266 345/82
2008/0106541 A1* 5/2008 Yamazaki ..... G09G 3/3655 345/212
2008/0180463 A1* 7/2008 Ogura ..... G09G 3/325 345/690
2014/0035895 A1* 2/2014 Toyomura ..... H01L 27/3276 345/211
2014/0035974 A1* 2/2014 Jinta ..... G09G 3/02 345/698
2014/0085347 A1* 3/2014 Yatabe ..... G09G 3/3648 345/690
2014/0333682 A1* 11/2014 Okuno ..... G09G 3/3291 345/690
2015/0009109 A1* 1/2015 Hwang ..... G09G 3/3614 345/87
2015/0029238 A1* 1/2015 Kanda ..... G09G 3/3291 345/690
2016/0253953 A1* 9/2016 Yang ..... G09G 3/2074 345/214
2016/0253955 A1* 9/2016 Wu ..... G09G 3/2003 345/690
2016/0335937 A1* 11/2016 Lee ..... G09G 3/2074
2017/0069262 A1* 3/2017 Wu ..... G09G 3/3233
2017/0200412 A1* 7/2017 Gu ..... G09G 5/005
2017/0270868 A1* 9/2017 Li ..... G09G 3/3266
2018/0075791 A1* 3/2018 Li ..... G09G 3/006
2018/0083078 A1* 3/2018 Park ..... H01L 29/42312

FOREIGN PATENT DOCUMENTS

CN 106707648 A 5/2017
CN 107863071 A 3/2018
CN 108335663 A 7/2018

OTHER PUBLICATIONS

Second Office Action for CN Patent Application No. 201810942594.6 dated Aug. 3, 2020.

* cited by examiner

DRIVING CIRCUIT, DISPLAY PANEL, AND CONTROL METHOD THEREOF

CROSS REFERENCE

This application is based upon and claims priority to Chinese Patent Application No. 201810942594.6, filed on Aug. 17, 2018, the entire contents thereof are incorporated herein by reference.

TECHNICAL FIELD

The present disclosure relates to the field of display technology, and particularly to a driving circuit, a display panel and a control method thereof.

BACKGROUND

At present, virtual reality (VR) display provides users with brand-new visual perceptions, and hence receives more and more attentions and favors from the users. At the same time, mobile game has gradually become one of important leisure and entertainment ways for young people. However, both of a VR display mode and a game mode require for a display panel to adopt a relatively higher refresh rate.

When the refresh rate of the display panel is raised to reach 90 Hz and even 120 Hz, a conventional driving method may involve the problem of insufficient compensation capacity of threshold voltage, which results in uneven display.

SUMMARY

The present disclosure provides a driving circuit, a display panel and a control method thereof, to solve the problem of uneven display resulted by poor compensation capacity of threshold voltage.

In order to solve the problem above, the present disclosure discloses a driving circuit for driving pixel circuits arranged in an array. The driving circuit includes a plurality of driving modules and a plurality of data writing modules. Each of the plurality of driving modules is connected to two adjacent rows of the pixel circuits through a controlling line and is configured to drive the two adjacent rows of pixel circuits simultaneously. Each of the plurality of data writing modules is connected to a data line and one column of pixel circuits, respectively, and is configured to write display data of the data line into a pixel circuit of odd row and a pixel circuit of even row in the one column of pixel circuits in a time sharing manner while the driving module driving the pixel circuits.

In some arrangements, the driving module includes a first GOA unit and a second GOA unit. The controlling line includes a first controlling line and a second controlling line. The first GOA unit is connected to the adjacent two rows of pixel circuits through the first controlling line, and is configured to control the adjacent two rows of pixel circuits to be reset and to set a threshold voltage. The second GOA unit is connected to the adjacent two rows of pixel circuits through the second controlling line, and is configured to control the adjacent two rows of pixel circuits to emit light.

In some arrangements, an effective level width of an output signal of the first GOA unit is two clock cycles.

In some arrangements, the data writing module includes a first switching transistor and a second switching transistor. The data line includes a data line of odd row and a data line of even row. The first switching transistor is connected to the data line of odd row and the pixel circuit of odd row, respectively. The first switching transistor is configured to be turned on according to a preset time sequence so as to write display data of the data line of odd row into the pixel circuit of odd row. The second switching transistor is connected to the data line of even row and the pixel circuit of even row, respectively. The second switching transistor is configured to be turned on according to the preset time sequence so as to write display data of the data line of even row into the pixel circuit of even row.

In some arrangements, the first switching transistor and the second switching transistor connected to one column of pixel circuits are turned on in a time sharing manner.

In some arrangements, the first switching transistor connected to one column of pixel circuits and the second switching transistor connected to adjacent, another column of pixel circuits are turned on simultaneously.

An arrangement of the present disclosure further provides a display panel. The display panel includes the driving circuit described above, a controlling chip, and pixel circuits arranged in an array. The controlling chip is connected to the driving circuit, and the driving circuit is connected to the pixel circuits. The controlling chip is configured to input display data into the driving circuit according to a preset time sequence. The driving circuit is configured to drive two adjacent rows of pixel circuits simultaneously according to the preset time sequence, and to write the display data into a pixel circuit of odd row and a pixel circuit of even row in a time sharing manner while driving the adjacent two rows of pixel circuits. The pixel circuit is configured to perform display according to the display data under a drive of the driving circuit.

In some arrangements, the controlling chip is provided with a data channel, and the data channel includes a data channel of odd row and a data channel of even row when the controlling line includes a data line of odd row and a data line of even row. The data channel of odd row is connected to the driving circuit through the data line of odd row, and the data channel of even row is connected to the driving circuit through the data line of even row. The controlling chip is configured to input the display data to the data line of odd row and the data line of even row according to the preset time sequence.

In some arrangements, the pixel circuit includes sub-pixel units, and the number of the data channel is two times or three times of the number of column of the sub-pixel units.

In some arrangements, the display panel is an Active-matrix organic light emitting diode (AMOLED) panel.

An arrangement of the present disclosure further provides a control method of a display panel, applied to the display panel described above. The control method includes driving two adjacent rows of pixel circuits according to a preset time sequence. The control method includes writing display data into a pixel circuit of odd row and a pixel circuit of even row in the two adjacent rows of pixel circuits in a time sharing manner according to the preset time sequence. The control method includes performing display according to the display data.

In some arrangements, driving two adjacent rows of pixel circuits according to a preset time sequence includes controlling the two adjacent rows of pixel circuits to be reset and to set a threshold voltage according to the preset time sequence, and controlling the two adjacent rows of pixel circuits to emit light according to the preset time sequence.

In some arrangements, writing display data into a pixel circuit of odd row and a pixel circuit of even row in the two adjacent rows of pixel circuits in a time sharing manner according to the preset time sequence includes controlling a first switching transistor and a second switching transistor connected to one column of pixel circuits to be turned on in a time sharing manner according to the preset time sequence.

In some arrangements, the control method further includes controlling a first switching transistor connected to one column of pixel circuits and a second switching transistor connected to adjacent, another column of pixel circuits to be turned on simultaneously according to the preset time sequence.

DETAILED DESCRIPTION

In order to make above objects, features and improvements of the present disclosure more apparent and understandable, the present disclosure will be described as below in more details in conjunction with the accompanying drawings and particular arrangements.

Figure 1:
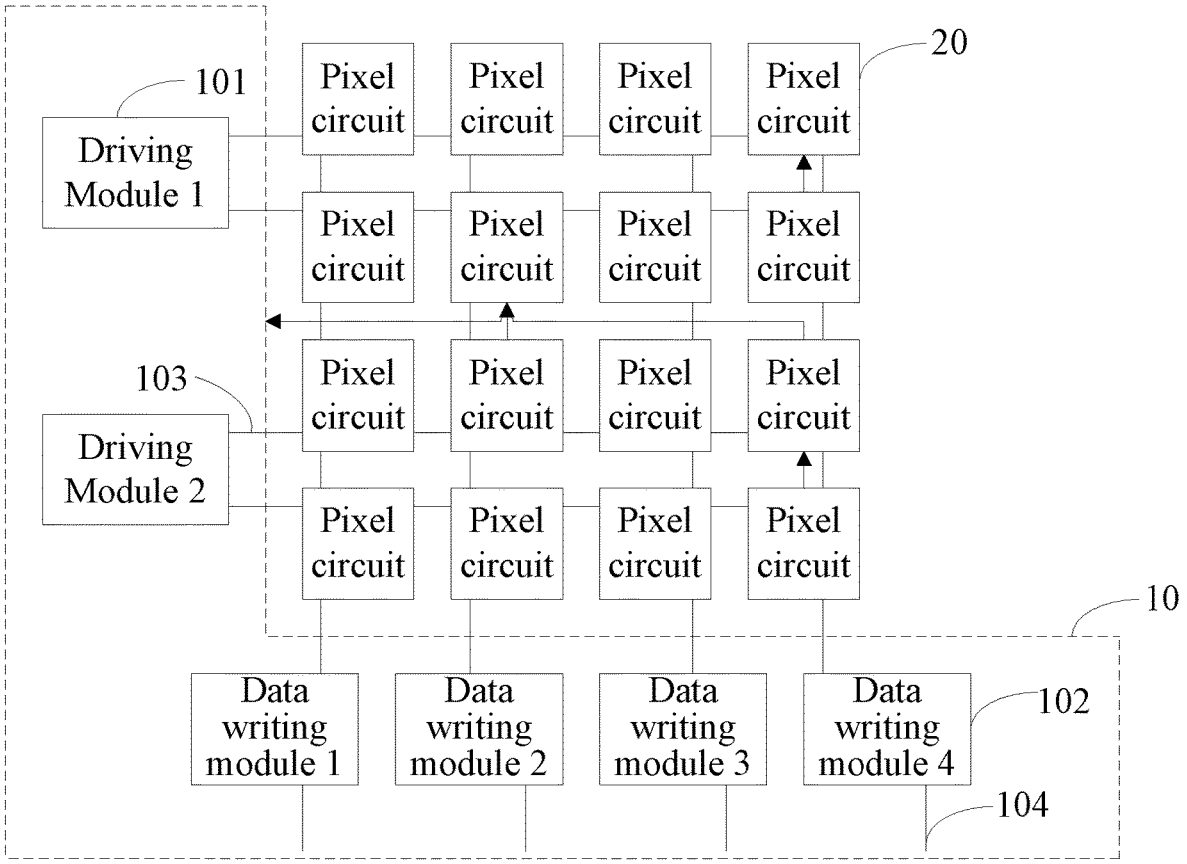
FIG. 1 is a structural diagram illustrating a driving circuit according to an exemplary arrangement of the present disclosure.

Referring to FIG. 1, a structural diagram of a driving circuit provided by an arrangement of the present disclosure is illustrated. The driving circuit 10 is configured to drive pixel circuits 20 arranged in an array. The driving circuit 10 includes a plurality of driving modules 101 and a plurality of data writing modules 102.

The driving module 101 is connected to adjacent two rows of pixel circuits 20 through a controlling line 103, and is configured to drive the adjacent two rows of pixel circuits 20 simultaneously.

The data writing module 102 is connected to a data line 104 and one column of pixel circuits 20, respectively, and is configured to write display data of the data line 104 into a pixel circuit of odd row and a pixel circuit of even row in the one column of pixel circuits 20 in a time sharing manner while the driving module 101 driving the pixel circuits 20.

In the present arrangement, the pixel circuit 20 may adopt a 7T1C pixel circuit, which is not particularly limited in the arrangements of the present disclosure but may be configured depending on actual conditions. The driving circuit 10 includes a plurality of driving modules 101 and a plurality of data writing modules 102. Each of the driving modules 101 is connected to adjacent two rows of pixel circuits 20 through a controlling line 103, and drives the adjacent two rows of pixel circuits 20 simultaneously. The plurality of driving modules 101 may be cascaded, and may drive two rows of pixel circuits 20 every time, according to a preset time sequence, from top to bottom sequentially. For example, driving pixel circuits of $1^{st}$ row and $2^{nd}$ row by a driving module 1 firstly, and then driving pixel circuits of $3^{rd}$ row and $4^{th}$ row by a driving module 2. Each of the data writing modules 102 is connected to a data line 104 and one column of pixel circuits 20, respectively. For example, the data writing module 1 is connected to pixel circuits of $1^{st}$ column, the data writing module 2 is connected to pixel circuits of $2^{nd}$ column, and the data writing module 3 is connected to pixel circuits of $3^{rd}$ column. When the driving module 101 drives the pixel circuit 20, the data writing module 102 writes the display data of the data line 104 into a pixel circuit of odd row and a pixel circuit of even row in one column of pixel circuits 20 in a time sharing manner. For example, when the driving module 1 drives pixel circuits of $1^{st}$ row and $2^{nd}$ row, the data writing module 1 writes display data into pixel circuits of $1^{st}$ row in the $1^{st}$ column firstly, and then writes display data into pixel circuits of $2^{nd}$ row in the $1^{st}$ column; the data writing module 2 writes the display data into pixel circuits of $2^{nd}$ row in the $2^{nd}$ column firstly, and then writes the display data into pixel circuits of $1^{st}$ row in the $2^{nd}$ column, which is not particularly limited in the arrangements of the present disclosure but may be configured depending on actual conditions.

Figure 2:
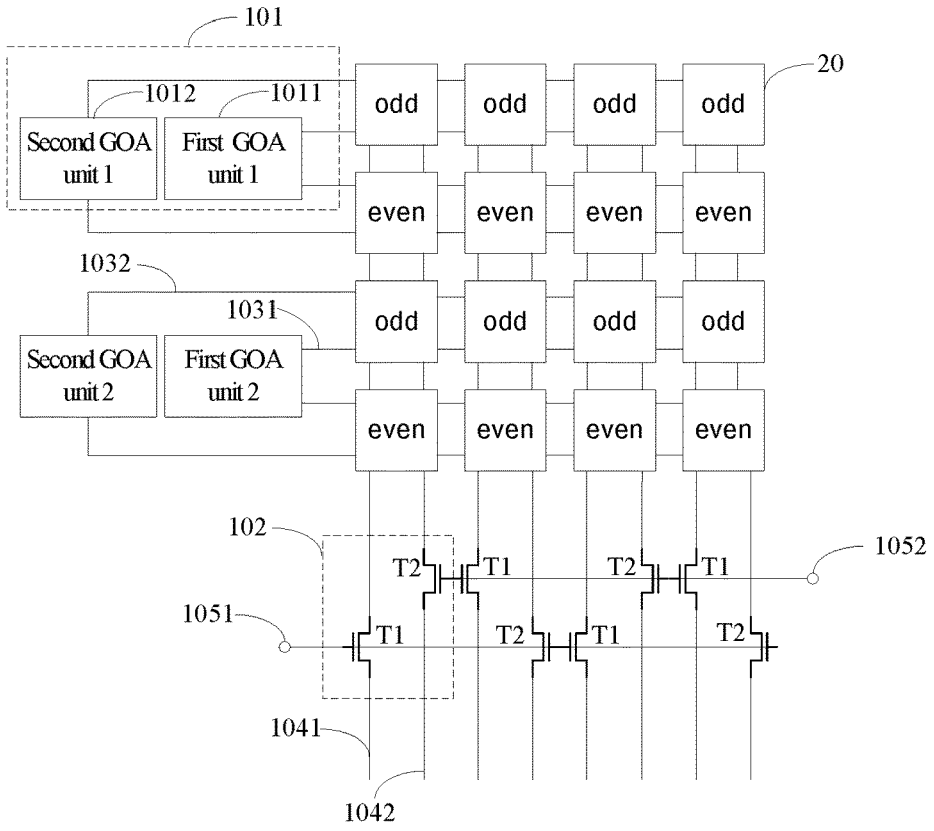
FIG. 2 is another structural diagram illustrating the driving circuit according to the exemplary arrangement of the present disclosure.

Optionally, referring to the structural diagram of the driving circuit illustrated in FIG. 2, the driving module 101 includes a first GOA unit 1011 and a second GOA unit 1012; the controlling line 103 includes a first controlling line 1031 and a second controlling line 1032.

The first GOA unit 1011 is connected to the adjacent two rows of pixel circuits 20 through the first controlling line 1031, and is configured to control the adjacent two rows of pixel circuits 20 to be reset and to set a threshold voltage.

The second GOA unit 1012 is connected to the adjacent two rows of pixel circuits 20 through the second controlling line 1032, and is configured to control the adjacent two rows of pixel circuits 20 to emit light.

In the present arrangement, the driving module 101 includes a first GOA unit 1011 and a second GOA unit 1012. The first GOA unit 1011 is connected to adjacent two rows of pixel circuits 20 through the first controlling line 1031 so that the adjacent two rows of pixel circuits 20 can be reset and perform setting a threshold voltage simultaneously. Referring to the waveform diagram of the preset time sequence illustrated in FIG. 3, the first GOA unit 1 outputs a reset signal Reset1. When the reset signal Reset1 is a low level, the pixel circuits 20 of $1^{st}$ row and $2^{nd}$ row are reset. The first GOA unit 1 outputs a setting threshold signal Gate1. When the setting threshold signal Gate1 is a low level, the pixel circuits 20 of $1^{st}$ row and $2^{nd}$ row set a threshold voltage. The first GOA unit 2 outputs a reset signal Reset2. When the reset signal Reset2 is a low level, the pixel circuits 20 of $3^{rd}$ row and $4^{th}$ row are reset. The first GOA unit 2 outputs a setting threshold signal Gate2. When the setting threshold signal Gate2 is a low level, the pixel circuits 20 of $3^{rd}$ row and $4^{th}$ row set a threshold voltage. As it can be seen, the time for the $1^{st}$ row and $2^{nd}$ row to set the threshold voltage is relatively longer, that is, the compensation time of threshold voltage of the pixel circuits is increased, so as to meet the compensation capacity of threshold voltage under a relatively higher refresh rate.

The second GOA unit 1 outputs a light-emitting signal EM1, when the pixel circuits of $1^{st}$ row and $2^{nd}$ row are reset and set a threshold voltage, the light-emitting signal EM1 is a high level, the pixel circuits of $1^{st}$ row and $2^{nd}$ row are controlled to not to emit light; after the threshold voltage of the pixel circuits of $1^{st}$ row and $2^{nd}$ row is established, the light-emitting signal EM1 is a low level, the pixel circuits of $1^{st}$ row and $2^{nd}$ row are controlled to emit light. Likewise, the second GOA unit 2 outputs a light-emitting signal EM2, when the pixel circuits of $3^{rd}$ row and $4^{th}$ row are reset and set a threshold voltage, the light-emitting signal EM2 is a high level, the pixel circuits of $3^{rd}$ row and $4^{th}$ row are controlled to not to emit light; after the threshold voltage of the pixel circuits of $3^{rd}$ row and $4^{th}$ row is established, the light-emitting signal EM2 is a low level, the pixel circuits of $3^{rd}$ row and $4^{th}$ row are controlled to emit light.

Optionally, an effective level width of an output signal of the first GOA unit 1011 may be two clock cycles.

Figure 3:
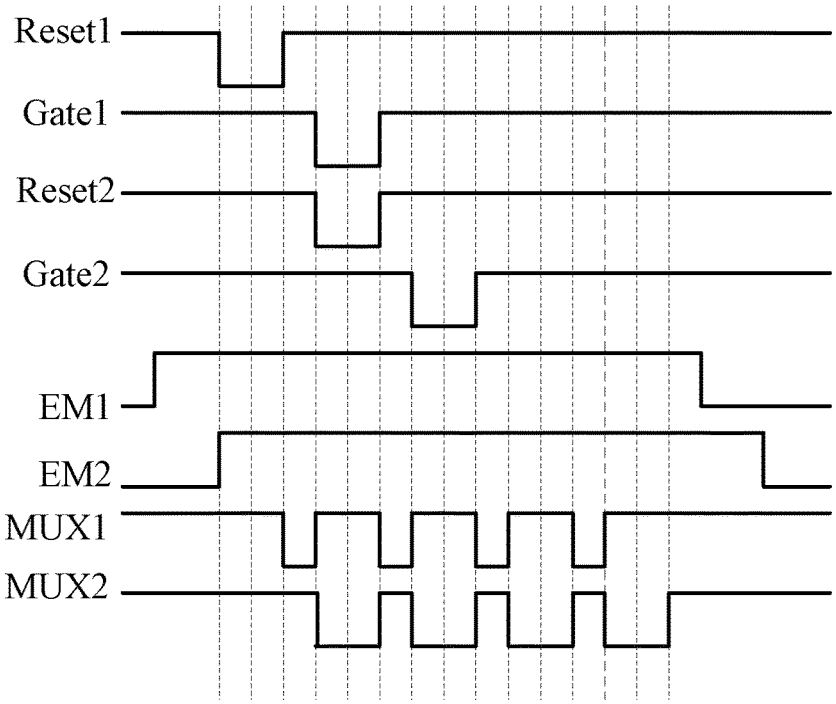
FIG. 3 is a waveform diagram illustrating a preset time sequence according to the exemplary arrangement of the present disclosure.

In the present arrangement, referring to FIG. 3, the effective level width of the output signals Gate1 and Gate 2 is two clock cycles.

Optionally, referring to the structural diagram of the driving circuit illustrated in FIG. 2, the data writing module 102 includes a first switching transistor T1 and a second switching transistor T2; the data line 104 includes a data line 1041 of odd row and a data line 1042 of even row.

The first switching transistor T1 is connected to the data line 1041 of odd row and the pixel circuit of odd row, respectively; the first switching transistor T1 is configured to be turned on according to a preset time sequence, so that the display data of the data line 1041 of odd row is written into the pixel circuit of odd row.

The second switching transistor T2 is connected to the data line 1042 of even row and the pixel circuit of even row, respectively; the second switching transistor T2 is configured to be turned on according to the preset time sequence, so that the display data of the data line 1042 of even row is written into the pixel circuit of even row.

In the present arrangement, the first switching transistor T1 is connected to the data line 1041 of odd row and the pixel circuit of odd row, respectively; the second switching transistor T2 is connected to the data line 1042 of even row and the pixel circuit of even row, respectively. For example, the first switching transistor T1 is connected to the data line 1041 of odd row and the pixel circuits of $1^{st}$ row, $3^{rd}$ row, $5^{th}$ row and the like; the second switching transistor T2 is connected to the data line 1042 of even row and the pixel circuits of $2^{nd}$ row, $4^{th}$ row, $6^{th}$ row and the like. When the first switching transistor T1 is turned on, the display data of the data line 1041 of odd row is written into the pixel circuits of $1^{st}$ row, $3^{rd}$ row, $5^{th}$ row and the like; when the second switching transistor T2 is turned on, the display data of the data line 1042 of even row is written into the pixel circuits of $2^{nd}$ row, $4^{th}$ row, $6^{th}$ row and the like.

Optionally, referring to the waveform diagram illustrated in FIG. 3, the first switching transistor T1 and the second switching transistor T2 connected to one column of pixel circuits are turned on in a time sharing manner.

In the present arrangement, the signal MUX1 of FIG. 3 is input into 1051 of FIG. 2, the signal MUX2 of FIG. 3 is input into 1052 of FIG. 2, and the signal MUX1 and the signal MUX2 control the first switching transistor T1 and the second switching transistor T2 to be turned on and turned off, respectively. When the signal MUX1 is a low level, the first switching transistor T1 or the second switching transistor T2 is turned on. When the signal MUX2 is a low level, the first switching transistor T1 or the second switching transistor T2 is turned on. For a same column of pixel circuits 20, the first switching transistor T1 and the second switching transistor T2 are turned on in a time sharing manner.

Optionally, the first switching transistor T1 connected to one column of pixel circuits and the second switching transistor T2 connected to adjacent, another column of pixel circuits are turned on simultaneously.

In the present arrangement, referring to the connection relationships in FIG. 2, the first switching transistor T1 connected to the pixel circuits of $1^{st}$ column and the second switching transistor T2 connected to the pixel circuits of $2^{nd}$ column are turned on simultaneously, and the second switching transistor T2 connected to the pixel circuits of $1^{st}$ column and the first switching transistor T1 connected to the pixel circuits of $2^{nd}$ column are turned on simultaneously.

As above, in the arrangement of the present disclosure, the driving circuit includes a plurality of driving modules and a plurality of data writing modules. The driving module drives adjacent two rows of pixel circuits simultaneously. The data writing module writes display data of a data line into a pixel circuit of odd row and a pixel circuit of even row in one column of pixel circuits in a time sharing manner while the driving module driving the pixel circuits. The driving module can drive adjacent two rows of pixel circuits simultaneously, which increases a compensation time of threshold voltage, so as to meet a compensation capacity of VTH under a relatively higher refresh rate and ensure a display effect. Furthermore, the data writing module writes the display data into the pixel circuit of odd row and the pixel circuit of even row in a time sharing manner, so as to prevent from a vertical line Mura resulted by a coupling capacitance between a data line of odd row and a data line of even row, thus improving a display quality.

Figure 4:
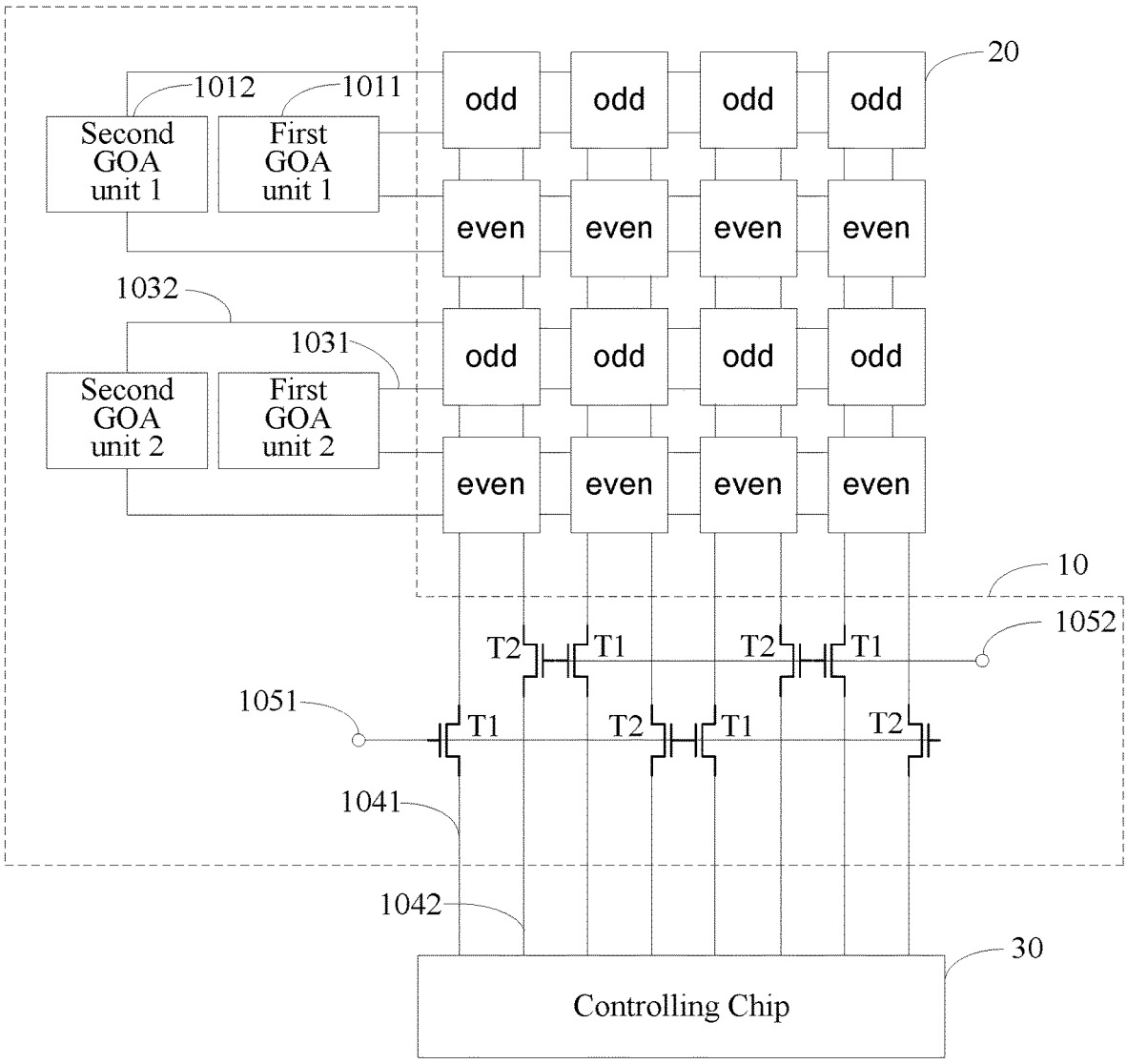
FIG. 4 is a structural diagram illustrating a display panel according to another exemplary arrangement of the present disclosure.

Referring to FIG. 4, a structural diagram of a display panel provided by an arrangement of the present disclosure is illustrated. The display panel includes a driving circuit, for example, the driving circuit 10 as described in the first arrangement, as well as a controlling chip 30 and pixel circuits 20 arranged in an array; the controlling chip 30 is connected to the driving circuit 10, and the driving circuit 10 is connected to the pixel circuits 20.

The controlling chip 30 is configured to input display data to the driving circuit 10 according to the preset time sequence.

The driving circuit 10 is configured to drive adjacent two rows of pixel circuits 20 simultaneously according to the preset time sequence, and to write the display data into the pixel circuit of odd row and the pixel circuit of even row in a time sharing manner while driving the adjacent two rows of pixel circuits 20.

The pixel circuit 20 is configured to perform display according to the display data under a drive of the driving circuit 10.

In the present arrangement, the pixel circuits 20 are arranged in an array on a display substrate, and the pixel circuit 20 may adopt a 7T1C pixel circuit, which is not particularly limited in the arrangements of the present disclosure but may be selected depending on actual conditions. The controlling chip 30 is connected to the driving circuit 10, and inputs display data to the driving circuit according to a preset time sequence. The driving circuit 10 drives the pixel circuits 20 according to the preset time sequence so that the pixel circuits 20 can be reset and set a threshold voltage, and the driving circuit 10 writes the display data into the pixel circuit of odd row and the pixel circuit of even row in a time sharing manner. After the threshold voltage of the pixel circuit 20 is established, the driving circuit 10 inputs a light-emitting signal EM to the pixel circuit 20 to emit light, and the pixel circuit 20 performs display according to the display data. FIG. 3 is a waveform diagram illustrating a preset time sequence. The preset time sequence is not particularly limited in the arrangement of the present disclosure, but may be configured depending on actual conditions.

Optionally, the controlling chip 30 is provided with a data channel 301; when the data line 104 includes a data line 1041 of odd row and a data line 1042 of even row, the data channel 301 includes a data channel 3011 of odd row and a data channel 3012 of even row.

The data channel 3011 of odd row is connected to the driving circuit 10 through the data line 1041 of odd row, and the data channel 3012 of even row is connected to the driving circuit 10 through the data line 1042 of even row.

The controlling chip 30 is configured to input the display data to the data line 1041 of odd row and the data line 1042 of even row according to the preset time sequence.

In the present arrangement, the data channel 301 of the controlling chip 30 is configured according to the data line 104; when the data line 104 includes a data line 1041 of odd row and a data line 1042 of even row, the data channel 301 includes a data channel 3011 of odd row and a data channel 3012 of even row. The data channel 3011 of odd row inputs display data to the data line 1041 of odd row, and the data channel 3012 of even row inputs display data to the data line 1042 of even row.

Optionally, the pixel circuit 20 includes sub-pixel units; and the number of data channel 301 is two times or three times of the number of column of the sub-pixel units.

In the present arrangement, when the sub-pixel unit is a RGB pixel, the number of the data channel 301 is two times of the number of column of the sub-pixel units; when the sub-pixel unit is a Sub Pixel Rendering (SPR) pixel, the number of the data channel 301 is three times of the number of column of the sub-pixel units.

Optionally, the display panel is an Active-matrix organic light emitting diode (AMOLED) display panel.

As above, in the arrangement of the present disclosure, the display panel includes a driving circuit, as well as a controlling chip and pixel circuits arranged in an array; the controlling chip inputs display data to the driving circuit according to a preset time sequence; the driving circuit drives adjacent two rows of pixel circuits simultaneously according to the preset time sequence, and writes the display data into a pixel circuit of odd row and a pixel circuit of even row in a time sharing manner while driving the adjacent two rows of pixel circuits; the pixel circuits perform display according to the display data under a drive of the driving circuit. With the arrangement of the present disclosure, it increases a compensation time of threshold voltage, so as to meet a compensation capacity of VTH under a relatively higher refresh rate and ensure a display effect; furthermore, it prevents from a vertical line Mura resulted by a coupling capacitance between a data line of od row and a data line of even row, thus improving a display quality.

Figure 5:
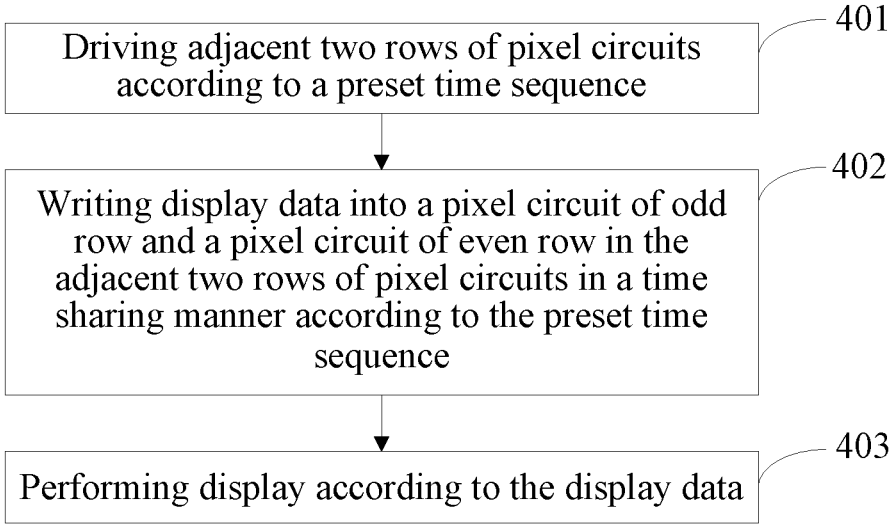
FIG. 5 is a flow chart illustrating a control method of a display panel according to still another exemplary arrangement of the present disclosure.

Referring to FIG. 5, a flow chart of a control method of a display panel provided by an arrangement of the present disclosure is illustrated. The control method is applied to, for example, the display panel as described in the second arrangement, and includes the blocks as described below.

In block S401, adjacent two rows of pixel circuits are driven according to a preset time sequence.

In the present arrangement, a driving signal is input to adjacent two rows of pixel circuits according to a preset time sequence. For example, the adjacent two rows of pixel circuits are controlled to be reset and to set a threshold voltage according to the preset time sequence; and the adjacent two rows of pixel circuits are controlled to emit light according to the preset time sequence.

In block S402, display data is written into a pixel circuit of odd row and a pixel circuit of even row in the adjacent two rows of pixel circuits in a time sharing manner according to the preset time sequence.

In the present arrangement, the display data is written into the pixel circuit of odd row and the pixel circuit of even row in the adjacent two rows of pixel circuits in a time sharing manner according to the preset time sequence. For example, a first switching transistor is controlled to connect to one column of pixel circuits and a second switching transistor connect to adjacent, and another column of pixel circuits are controlled to be turned on simultaneously according to the preset time sequence.

In block S403, display is performed according to the display data.

In the present arrangement, after writing the display data into the pixel circuits, the pixel circuits receive a light-emitting signal and perform display according to the display data.

As above, in the arrangement of the present disclosure, adjacent two rows of pixel circuits are driven according to a preset time sequence; display data is written into a pixel circuit of odd row and a pixel circuit of even row in the adjacent two rows of pixel circuits in a time sharing manner according to the preset time sequence; and display is performed according to the display data. By way of the arrangement of the present disclosure, a compensation time of threshold voltage is increased, so as to meet a compensation capacity of VTH under a relatively higher refresh rate and ensure a display effect. Furthermore, it prevents from a vertical line Mura resulted by a coupling capacitance between a data line of odd row and a data line of even row, thus improving a display quality.

The arrangements in the present disclosure are described in a progressive manner, and each of the arrangements is emphasized on its distinction(s) from others. Identical or similar content(s) between different arrangements may be referred to each other.

Finally, it should also be explained that, terms of relations like "first", "second", etc., as used in the present disclosure are merely for distinguishing one entity or operation from another entity or operation, without necessarily requiring for or implying any of such actual relation(s) or sequence(s) to be existed between these entities or operations. Furthermore, terms like "comprise", "include" or any other variation(s) thereof are intended to cover nonexclusive inclusion relation(s) so that a process, a method, a product or an apparatus including a series of elements includes not only those elements but also other elements which are not definitely listed, or includes inherent element(s) of such process, method, product or apparatus. In case of no other limitation(s), an element defined by the expression of "comprises/comprising (includes/including) one . . . " is not intended to exclude the case(s) where the process, method, product or apparatus including such element further includes other similar element(s).

In the above, detailed explanations of a driving circuit, a display panel and a control method thereof provided by the present disclosure are set forth. Particular cases are utilized in the present disclosure to explain principle(s) and implementation(s) of the present disclosure. The arrangements above are merely for facilitating understanding the method(s) of the present disclosure and essential concept(s) thereof; at the same time, for those ordinary skilled in the art, modification(s) to particular implementation(s) and application scope(s) may be made in accordance with the concept(s) of the present disclosure. Therefore, contents of the present disclosure should not be interpreted as any limitation(s) to the present disclosure.

What is claimed is:

1. A driving circuit for driving pixel circuits arranged in an array, the driving circuit comprising a plurality of driving modules and a plurality of data writing modules, wherein each of the plurality of driving modules is connected to two adjacent rows of pixel circuits through a controlling line and is configured to drive the two adjacent rows of pixel circuits simultaneously; and each of the plurality of data writing modules is connected to a data line and one column of pixel circuits, respectively, and is configured to write display data of the data line into a pixel circuit of odd row and a pixel circuit of even row in the one column of pixel circuits in a time sharing manner in response to the plurality of driving modules driving the pixel circuits, wherein the plurality of data writing modules each comprises a first switching transistor and a second switching transistor; and the data line comprises a data line of odd row and a data line of even row, and wherein, the first switching transistor is connected to the data line of odd row and the pixel circuit of odd row, respectively, and the first switching transistor is configured to be turned on according to a preset time sequence and write display data of the data line of odd row into the pixel circuit of odd row by turning on; and the second switching transistor is connected to the data line of even row and the pixel circuit of even row, respectively, and the second switching transistor is configured to be turned on according to the preset time sequence and write display data of the data line of even row into the pixel circuit of even row by turning on, wherein the first switching transistor connected to one column of the pixel circuits and the second switching transistor connected to adjacent, another column of the pixel circuits are turned on simultaneously.

2. The driving circuit according to claim 1, wherein the plurality of driving modules each comprises a first GOA unit and a second GOA unit; and the controlling line comprises a first controlling line and a second controlling line, and wherein, the first GOA unit is connected to the adjacent two rows of pixel circuits through the first controlling line, and is configured to control the adjacent two rows of pixel circuits to be reset and to set a threshold voltage; and the second GOA unit is connected to the adjacent two rows of pixel circuits through the second controlling line, and is configured to control the adjacent two rows of pixel circuits to emit light.

3. The driving circuit according to claim 2, wherein an effective level width of an output signal of the first GOA unit is two clock cycles.

4. The driving circuit according to claim 1, wherein the first switching transistor and the second switching transistor connected to one column of the pixel circuits are turned on in a time sharing manner.

5. A display panel, comprising a driving circuit for driving pixel circuits arranged in an array, and a controlling chip, the controlling chip connected to the driving circuit, and the driving circuit connected to the pixel circuits, wherein the driving circuit comprises a plurality of driving modules and a plurality of data writing modules, and wherein each of the plurality of driving modules is connected to two adjacent rows of the pixel circuits through a controlling line and is configured to drive the two adjacent rows of the pixel circuits simultaneously; and each of the plurality of data writing modules is connected to a data line and one column of the pixel circuits, respectively, and is configured to write display data of the data line into a pixel circuit along an odd row and a pixel circuit along an even row in the one column of the pixel circuits in a time sharing manner in response to the plurality of driving modules driving the pixel circuits;

wherein the controlling chip is configured to input display data to the driving circuit according to a preset time sequence;

the driving circuit is configured to drive two adjacent rows of the pixel circuits simultaneously according to the preset time sequence, and to write the display data into the pixel circuit along the odd row and the pixel circuit along the even row in the time sharing manner while driving the adjacent two rows of the pixel circuits; and the pixel circuits are configured to perform display according to the display data under a drive of the driving circuit, wherein the plurality of data writing modules each comprises a first switching transistor and a second switching transistor; and the data line comprises a data line of odd row and a data line of even row, and wherein, the first switching transistor is connected to the data line of odd row and the pixel circuit of odd row, respectively, and the first switching transistor is configured to be turned on according to a preset time sequence and write display data of the data line of odd row into the pixel circuit of odd row by turning on; and the second switching transistor is connected to the data line of even row and the pixel circuit of even row, respectively, and the second switching transistor is configured to be turned on according to the preset time sequence and write display data of the data line of even row into the pixel circuit of even row by turning on, wherein the first switching transistor connected to one column of the pixel circuits and the second switching transistor connected to adjacent, another column of the pixel circuits are turned on simultaneously.

6. The display panel according to claim 5, wherein the controlling chip is provided with a data channel, and the data channel comprises a data channel of odd row and a data channel of even row upon the controlling line comprising a data line of odd row and a data line of even row, and wherein, the data channel of odd row is connected to the driving circuit through the data line of odd row, and the data channel of even row is connected to the driving circuit through the data line of even row; and the controlling chip is configured to input the display data to the data line of odd row and the data line of even row according to the preset time sequence.

7. The display panel according to claim 6, wherein the pixel circuits each comprises a plurality of sub-pixel units, and a number of the data channel is two times or three times of a number of columns of the plurality of sub-pixel units.

8. The display panel according to claim 5, wherein the plurality of driving modules each comprises a first GOA unit and a second GOA unit; and the controlling line comprises a first controlling line and a second controlling line, and wherein, the first GOA unit is connected to the adjacent two rows of pixel circuits through the first controlling line, and is configured to control the adjacent two rows of pixel circuits to be reset and to set a threshold voltage; and the second GOA unit is connected to the adjacent two rows of pixel circuits through the second controlling line, and is configured to control the adjacent two rows of pixel circuits to emit light.

9. The display panel according to claim 8, wherein an effective level width of an output signal of the first GOA unit is two clock cycles.

10. The display panel according to claim 5, wherein the first switching transistor and the second switching transistor connected to one column of the pixel circuits are turned on in a time sharing manner.

11. A control method of a display panel, applied to a display panel according to claim 5, the control method comprising:

driving adjacent two rows of pixel circuits according to the preset time sequence;

writing the display data into a pixel circuit along an odd row and a pixel circuit along an even row in the adjacent two rows of pixel circuits in the time sharing manner according to the preset time sequence; and performing display according to the display data, wherein control method further comprises:

controlling the first switching transistor connected to the one column of the pixel circuits and the second switching transistor connected to adjacent, another column of the pixel circuits to be turned on simultaneously according to the preset time sequence.

12. The control method according to claim 11, wherein driving adjacent two rows of pixel circuits according to a preset time sequence comprises:

controlling the adjacent two rows of pixel circuits to be reset and to set a threshold voltage according to the preset time sequence; and controlling the adjacent two rows of pixel circuits to emit light according to the preset time sequence.

13. The control method according to claim 11, wherein writing the display data into a pixel circuit along an odd row and a pixel circuit along an even row in the adjacent two rows of pixel circuits in the time sharing manner according to the preset time sequence comprises:

controlling the first switching transistor and the second switching transistor connected to one column of the pixel circuits to be turned on in the time sharing manner according to the preset time sequence.

* * * * *